United States Patent [19]

Yano et al.

[11] Patent Number: 4,776,900

[45] Date of Patent: Oct. 11, 1988

[54] PROCESS FOR PRODUCING NICKEL STEELS WITH HIGH CRACK-ARRESTING CAPABILITY

[75] Inventors: Seinosuke Yano; Naoki Saito, both of Kitakyushu, Japan

[73] Assignee: Nippon Steel Corporation, Tokyo, Japan

[21] Appl. No.: 106,916

[22] Filed: Oct. 5, 1987

Related U.S. Application Data

[63] Continuation of Ser. No. 798,870, Nov. 18, 1985, abandoned.

[30] Foreign Application Priority Data

Nov. 26, 1984 [JP] Japan ..... 59-248976

[51] Int. Cl.[4] ..... C21D 8/00

[52] U.S. Cl. ..... 148/12 R; 148/12.1; 148/336

[58] Field of Search ..... 148/12 R, 12.1, 12 F, 148/134, 336

[56] References Cited

U.S. PATENT DOCUMENTS 4,219,371 8/1980 Nakasugi et al. ..... 148/12 F 4,534,805 8/1985 Jesseman ..... 148/12 F

FOREIGN PATENT DOCUMENTS 2307879 12/1976 France .

OTHER PUBLICATIONS

Le Bon, Revue de Metallurgie, vol. 76, pp. 183–191, 12/1979 (with English translation).

*Primary Examiner*—L. Dewayne Rutledge
*Assistant Examiner*—S. Kastler
*Attorney, Agent, or Firm*—Wenderoth, Lind & Ponack

[57] ABSTRACT

A process for producing a Ni-steel with high crack-arresting capability is disclosed. The process comprises the steps of:

heating a steel material containing 2.0–10% of Ni to a temperature between 900 and 1,000° C.;

hot rolling the steel material to provide a cummulative reduction of 40–70% at 850° C. or below, and finishing the rolling operation at 700°–800° C.;

immediately after completion of the rolling step, quenching the steel material to a temperature not higher than 300° C.; and subsequently tempering the quenched slab at a temperture not higher than the $Ac_1$ point.

6 Claims, 5 Drawing Sheets

PROCESS FOR PRODUCING NICKEL STEELS WITH HIGH CRACK-ARRESTING CAPABILITY

This application is a continuation, of now abandoned application Ser. No. 798,870, filed Nov. 18, 1985 now abandoned.

BACKGROUND OF THE INVENTION

The present invention relates to a process for producing Ni-steels with high toughness having high crack-arresting capability and tensile strength values on the order of 50–100 kgf/mm$^2$ at low temperature.

In order to cope with the increasing consumption of energy, a great number of tanks are being built for storage of LPG and LNG, and this has led to an increasing demand for steel plates as structural components of cryogenic vessels. Steel plates containing 4.0–10% Ni are used to build cryogenic tanks instead of the conventional austenitic stainless steels. Two of the methods for producing such Ni-containing steels are described in Japanese Patent Publication No. 15215/1971 and Unexamined Published Japanese Patent Application No. 104427/1980. The first reference discloses "a three-stage process of heat treatment consisting of normalizing a low-carbon Ni-steel at a temperature not lower than the $Ac_3$ transformation point, heating and quenching the steel at temperatures between the $Ac_1$ and $Ac_3$ transformation points, and tempering the hardened steel at a temperature not higher than the $Ac_1$ transformation point". The second reference shows "a process comprising rolling a steel to provide a reduction of 60% or more in the temperature range of 1,100° C. to the $Ar_3$ transformation point, subsequently holding the rolled steel at a temperature between the $Ar_3$ and $Ar_1$ transformation points for a period of 30–60 minutes followed by quenching, and thereafter tempering the hardened steel at a temperature not higher than the $Ac_1$ transformation point". The Ni-containing steel plates produced by these methods exhibit high strength and superior toughness at cryogenic temperature.

However, with a view to preventing failure of LNG and LPG tanks, industry-wide efforts are being made to ensure even greater safety in cryogenic tanks by employing steel plates of high cryogenic toughness that have high strength, high crack-arresting capability and minimum variations in performance.

The term "crack-arresting capability" means the ability of a steel to stop the progress of brittle cracking occurring in the steel. While many processes are known to be capable of providing an improved crack-arresting capability, two are described here. Unexamined Published Japanese Patent Application No. 100624/1983 discloses "a method comprising rough hot-rolling a Ni-containing steel wherein Nb is combined with selective additions of B, Ti, Cu or Cr, then finish-rolling the steel at a temperature for the dual-phase region, followed by quenching and tempering".

This method depends on hot rolling at a temperature in the dual-phase region for attaining an improved crack-arresting capability. Another prior art method for producing a steel having an improved crack-arresting capability is described in Unexamined Published Japanese Patent Application No. 217629/1983. This method is characterized by controlling the cumulative reduction for rolling in a lower-temperature region, and comprises "heating a Ni-steel slab containing Cr and/or Mo to 1,150° C., then hot-rolling the slab at a temperature of 850° C. or below to impart a cumulative reduction of 60% or more, immediately thereafter water-cooling the rolled slab, following by tempering at a temperature not higher than the $Ac_1$ transformation point".

These methods are essentially the same as the methods described in Japanese Patent Publication No. 15215/1971 and Unexamined Published Japanese Patent Application No. 104427/1980 that are intended for producing steel plates having improved strength and low-temperature toughness. Each of these methods depends on producing a steel structure with finer grains for taking full advantage of the great ability of the Ni component to stop brittle cracking. The degree of improvement in crack-arresting capability acheived by these methods is not sufficient to be considered satisfactory and only inconsistent results are obtained.

SUMMARY OF THE INVENTION

The object of the present invention is to eliminate the above-mentioned defects of the Ni-containing steels. Therefore, the object of the present invention is to provide a process for producing a Ni-steel of high strength and toughness while ensuring consistent provision of high crack-arresting capability. In order to attain this object, the present inventors conducted a series of experiments and have found that the fracture toughness value (Kca) indicative of the crack-arresting capability is dependent on the effective grain size ($1\sqrt{d}\times 100$) as shown in the graph of FIG. 1.

The term "effective grain" as used herein is an imaginary grain that is bounded by tear lines as obtained by fractographic observation. Effective grain size is defined as a region in which cleavage cracks go through in a nearly straight fasion. Details of the description of the effective grain are found in Matsuda et al., "Toughness and Effective Grain Size in Heat-Treated Low-Alloy High-Strength Steels" in "Toward Improved Ductility and Toughness", CLIMAX MOLYBDENUM DEVELOPMENT COMPANY (JAPAN) LTD., (1971).

As suggested above, an improved crack-arresting capability can be attained by refining on the effective grain. the present iventors made various studies on the technique for refining on the effective grain, and have found that, as will be shown in detail hereinafter, the effective grain is dependent on (i) the temperature at which a steel slab is heated and (ii) the austenitic grain size.

The present invention has been accomplished on the basis of the finding described above and relates to the following methods:

1. A process for producing a Ni-steel with high crack-arresting capability comprising the steps of:
   - heating a steel material containing 2.0–10.0% of Ni to a temperature between 900° and 1,000° C.;
   - hot-rolling the steel material to provide a cumulative reduction of 40–70% at 850° C. or below, and finishing the rolling operation at 700°–800° C.;
   - immediately after completion of the rolling step, quenching the steel material to a temperature not higher than 300° C.; and
   - subsequently tempering the quenched steel material at a temperature not higher than the $Ac_1$ point.

The term "a steel material" means a cast product or steel product such as a slab, ingot, billet, bloom, steel plate or steel bar.

2. A process according to Paragraph 1 wherein said steel material further contains one or more elements selected from the group consisting of 0.05–1.0% Mo, 0.1–1.5% Cr, 0.1–2.0% Cu, and not more than 1.0% of Nb, V or Ti.

3. A process according to Paragraph 1 or 2 wherein the Ni content of the steel material ranges from 4.0 to 10%;

4. A process according to Paragraph 1 wherein the Ni content of the steel material ranges from 2.0 to less than 8%; and 5. A process according to any one of Paragraphs 1 to 4 wherein the steel material is quenched at a cooling rate of more than 10° C./sec.

BRIEF DESCRIPTION OF THE DRAWING

FIG. 3 depicts the effect on the effective grain size of the temperature at which the steel slab is heated; FIG. 4 illustrates the effect on the ratio of austenitic grain size ($d\gamma$) to effective grain size ($d_{eff}$) of the temperature at which the steel slab is heated; and FIG. 5 shows the correlation between the effective grain size and the austenitic grain size.

DETAILED DESCRIPTION OF THE INVENTION

As the starting material for the process of the present invention, a steel material is produced by forming a melt in a smelting furnace such as an electric furnace or converter and subjecting the melt either to continuous casting or to a combination of ingot making and cogging, said steel material consisting of 2.0–10.0% Ni, 0.01–0.20% C, not more than 0.5% of Si, 0.1–2.0 Mn, 0.005–0.1% sol. Al, and the balance being Fe and incidental impurities.

Nickel is present in the slab for the purpose of imparting low-temperature toughness to the steel. If the Ni content is less than 2.0%, the desired low-temperature toughness is not obtained, and if above 10%, the low-temperature toughness of the steel is saturated and no further increase is provided by the excess nickel present. If the Ni content is in the range of 2.0–4.0%, a steel with a low tensile strength (<55 kgf/mm$^2$) and high toughness is obtained. If the Ni content is in the range of 4.0–10%, a steel with a high tensile strength (≧55 kgf/mm$^2$) and high toughness results.

Carbon is added in order to ensure high strength and hardenability. If the carbon content is less than 0.01%, the hardenability of the steel is too low to warrant the desired strength. Above 0.20% C, the desired low-temperature toughness is not obtained.

Figure 1:
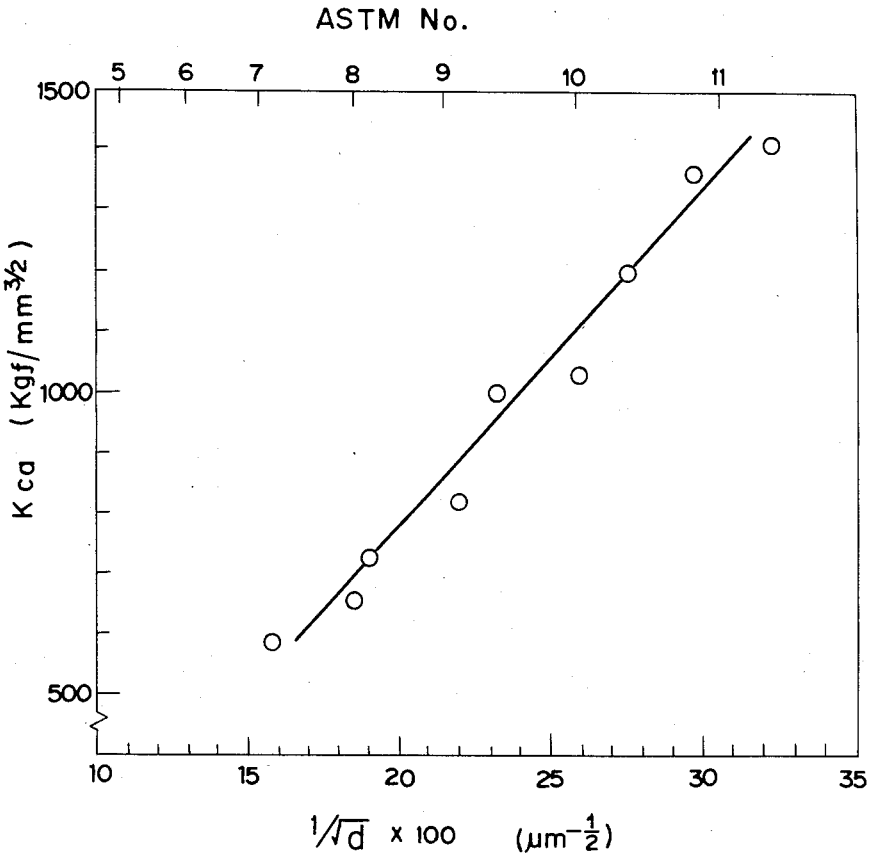
FIG. 1 is a graph showing the relationship between the effective grain size ($1\sqrt{d}\times 100$) and the fracture toughness value (Kca) as obtained by performing a CCA (Compact Crack Arrest) test on 9% Ni steel plates with a thickness of 32 mm that were produced under various conditions.
Figure 2:
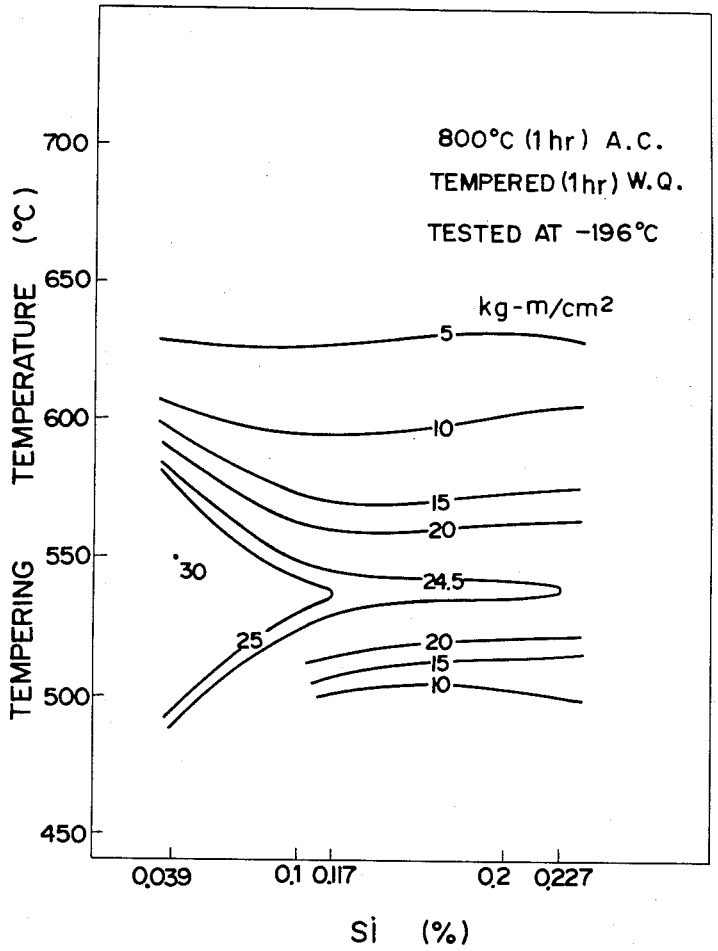
FIG. 2 shows the profiles of Si content and tempering temperature, with the energy (kg-m/cm$^2$) at −196° C. being taken as a parameter, for 9% Ni-steel samples that were air-cooled at 800° C. (1 hr , tempered and water-quenched.

Silicon is customarily added in steel making as a deoxidizing element that is also effective for ensuring the desired strength. If the Si content exceeds 0.5%, adverse effects on the low-temperature toughness become noticeable. A Si content of 0.04% or below is particularly preferred in that the temper brittleness at temperatures no higher than 500° C. is significantly improved as shown in FIG. 2.

Manganese is an element that may partially replace the Ni content for the purpose of providing improved hardenability and low-temperature toughness. Excessive addition of manganese will promote temper brittleness and a suitable range for manganese addition is from 0.1 to 2.0%.

Aluminum is added as a deoxidizer and is effective for refining the grain size of steel. The other important function of aluminum is to immobilize nitrogen in the steel, and in order to fulfill this function, aluminum must be present in an amount of at least 0.005%, but if it is added in an excessive amount, it may form an inclusion that is deleterious to the purpose of providing high cryogenic toughness. Therefore, the upper limit for aluminum addition is 0.1%.

In order to ensure further improvements in strength and low-temperature toughness and provide additional effects, the Ni-containing steel material may contain one or more optional elements selected from the group consisting of 0.05–1.0% Mo, 0.1–1.5% Cr, 0.1–2.0% Cu, and no more than 1.0% Nb, V or Ti. Molybdenum is particularly effective for expanding the optimum range of tempering temperature. Chromium is also effective for this purpose and it has additional advantage in that it will impart strength to the steel. Copper is effective for providing improved corrosion resistance and toughness. Niobium and vanadium are effective for imparting strength and refining on the matrix structure. Titanium is also effecting for providing finer gains.

The Ni-containing steel material having the composition specified above is obtained either by continuous casting or by the ingot-making process and cogging process. Immediately thereafter while the steel material is still hot or after cooling to a lower temperature, the steel material is heated to a temperature between 900° and 1,000° C. The steel material is then subjected to hot rolling under such conditions that the cumulative reduction at a temperature of 850° C. or below is 40–70% and that the finishing temperature is between 700 and 800° C. The temperature to which the steel material is heated before hot rolling must be in the range of 900 to 1,000° C.; this limitation is closely associated with the subsequent rolling step and is intended for ensuring the production of fine effective grains.

Figure 3:
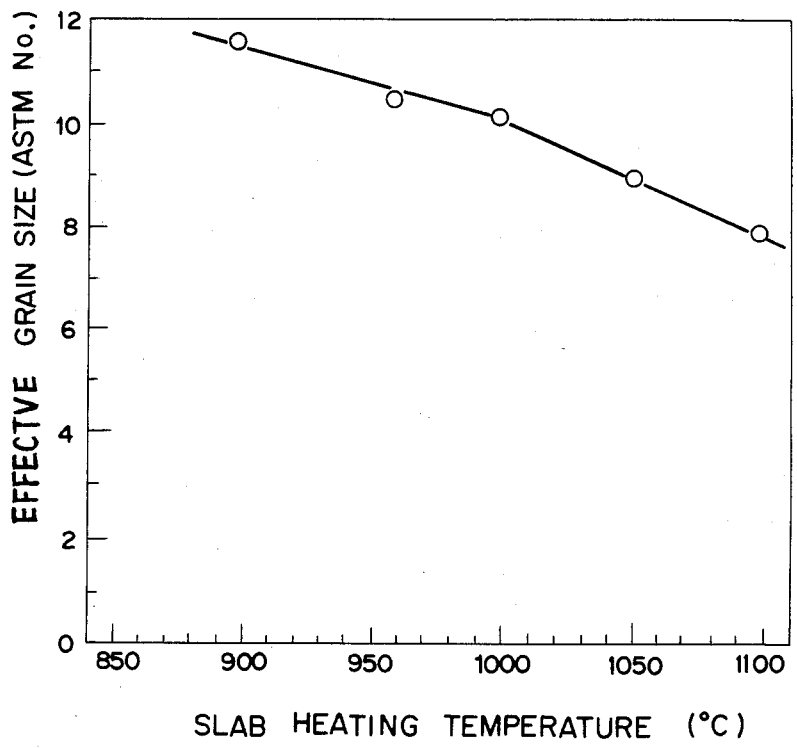
FIGS. 3 to 5 show three characteristics of 9% Ni-steels having the same composition.
Figure 4:
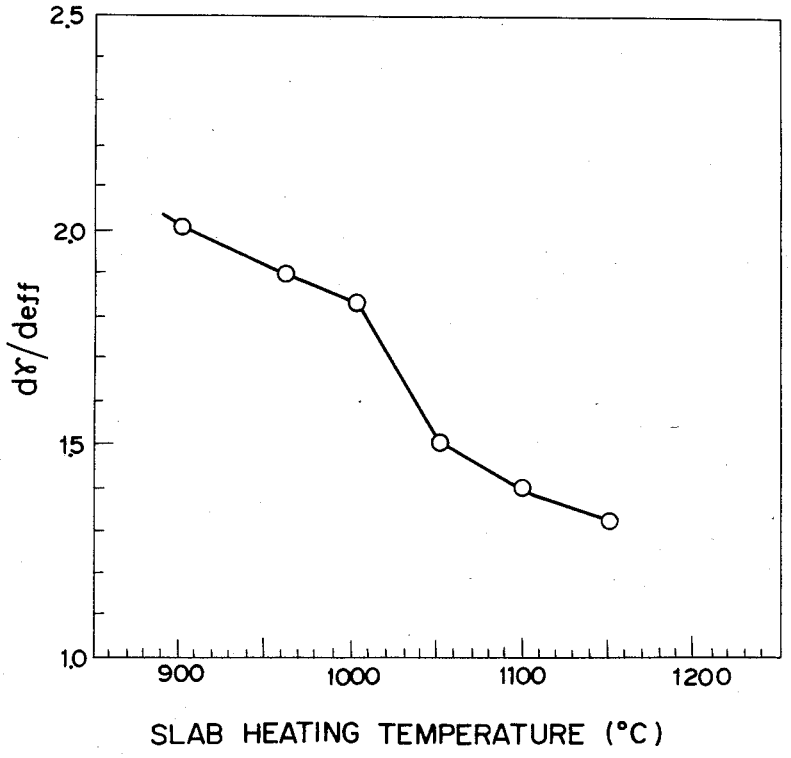

As a result of extensive studies made to work out a technique for refining on the effective grain, the present inventors have found that the size of effective grain has a tendency to decrease as the temperature at which the steel slab is heated decreases, as shown in FIG. 3, and that the ratio of austenitic grain size ($d\gamma$) to effective grain size ($d_{eff}$) has a tendency to increase as the temperature at which the steel slab is heated decreased, as depicted in FIG. 4.

The observations indicate that by properly controlling the temperature at which the steel slab is heated, the effective grain can be made finer than is possible with the prior art technique. It is contemplated on the basis of these observations that the steel slab should be heated at a temperature no higher than 1,000° C. for the purpose of refining the effective grain. However, if the slab is heated below 900° C., the range of the finishing temperature in the rolling operation that will be specified later in this specification cannot be observed and harmful effects arise relative to the purpose of attaining high cryogenic toughness.

Figure 5:
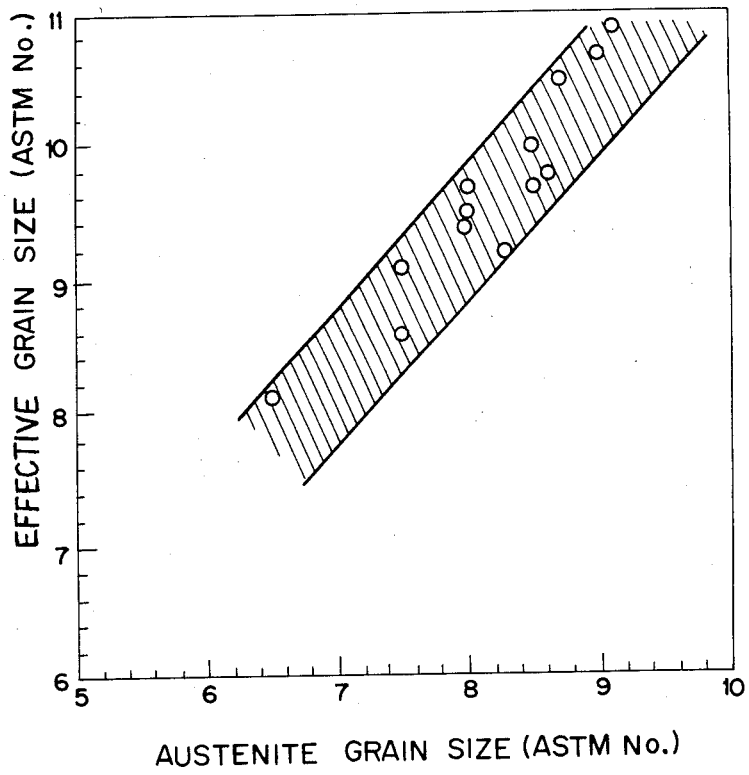

The heating of the steel slab is followed by hot rolling which is performed for the purpose of refining on the austenitic grains formed in the heating operation. According to another fining of the present inventors, a good correlation exists between the austenitic grain size and the effective grain size as depicted in FIG. 5. This suggests that not only the austenitic grain but also the effective grain can be refined by performing the hot-rolling operation in a systematic fashion. If the slab is hot-rolled at temperatures above 850° C., the recrystallization of austenite will occur simultaneously. Therefore, in order to obtain fine effective grains, the rolling step must be carried out systematically at temperatures not higher than 850° C. Even if the slab's temperature is 850° C. or below, a cumulative reduction of less than 40% is insufficient for refining on the effective grains by rolling. A reduction exceeding 70% is not detrimental to the purpose of refining on the coarse grain but then the fine grains obtained will aggregate by forming textures to provide a structure having no uniform crygenic toughness.

The limitation on the finishing temperature is intended to ensure the production of fine grains in the rolling step. If the finishing temperature is above 800° C., the fine-grained austenite structure formed by rolling will undergo recrystallization to produce coarse grains, which is contrary to the purpose of rolling. Below 700° C., the texture consisting of fine grains is formed extensively and ferrite transformation occurs. This prevents formation of the desired hardened structure by subsequent quenching and a product having the desired cryogenic toughness cannot be obtained.

After completion of the systematic heating and rolling process in the austenite region, the steel is immediately quenched to a predetermined temperature not higher than 300° C., followed by tempering at a temperature not higher than the $Ac_1$ point. The purpose of quenching after rolling is to obtain a fine-grained martensite, ferrite/bainite structure from the fine-grained austenite structure formed in the hot rolling. If the quenching is completed at a temperature above 300° C., a product of low-temperature transformation results and it considerably exerts a bad influence upon a cryogenic toughness of the steel. Moreover, the quenching of the present invention is carried out at a cooling rate of more than about 10° C./sec, and the sooner the cooling rate is, the more desirable it is.

In accordance with the present invention, the hot-rolled steel plate is immediately quenched to obtain the martensite, ferrite/bainite microstructure, so that the progress of recrystallization is negligible. In addition, the systematic heating and rolling scheme ensures the formation of a significantly fine-grained austenite structure upon completion of the rolling. Therefore, the martensite, ferrite/bainite structure obtained by quenching this austenite structure is also considerably fine-grained.

The so obtained fine-grained martensite, ferrite/bainite structure is then tempered at a temperature no higher than the $Ac_1$ point, and the effective grains in the final product have a fineness that has been previously unobtainable by the conventional refining procedure involving reheating, quenching and tempering. The present invention therefore enables the production of steel plates, pipes and bars having a higher crack-arresting capability than the prior art refined steels.

In order to demonstrate the superiority of the process of the present invention, steel plates having the compositions shown in Table 1 were produced under the conditions shown in Table 2. The properties of the resulting steel plates are also summarized in Table 2.

With regard to each of Sample Nos. 1–4, 6, 8–20, 22–27 of Table 2, the quenching after rolling was carried out at a cooling rate between 13 and 30° C./sec. With regard to each of Samples Nos. 5, 7 and 21, the air-cooling after rolling was carried out at a cooling rate between 0.3 and 0.6° C/sec.

TABLE 1

| | (wt %) Compositions | | | | | | | | | | |
|---|---|---|---|---|---|---|---|---|---|---|---|
| Steels | C | Si | Mn | P | S | Ni | Mo | Nb | Al | Cr | V |
| A1 | 0.05 | 0.25 | 0.57 | 0.006 | 0.001 | 9.18 | — | — | 0.040 | — | — |
| A2 | 0.05 | 0.23 | 0.54 | 0.005 | 0.001 | 9.10 | — | 0.10 | 0.035 | — | — |
| B1 | 0.10 | 0.25 | 1.08 | 0.004 | 0.002 | 5.65 | 0.21 | — | 0.038 | — | — |
| C1 | 0.05 | 0.28 | 0.56 | 0.006 | 0.004 | 4.21 | — | — | 0.041 | — | — |
| D | 0.11 | 0.26 | 0.61 | 0.008 | 0.001 | 2.18 | — | — | 0.036 | — | — |
| E | 0.10 | 0.23 | 0.55 | 0.006 | 0.002 | 3.54 | — | — | 0.038 | — | — |
| F | 0.09 | 0.28 | 0.62 | 0.005 | 0.001 | 5.14 | 0.51 | — | 0.026 | 0.52 | 0.06 |

TABLE 2

| Plate thickness (mm) | | Steels | Sample No. | Treatment on slab: Solid solution treatment positive | Treatment on slab: Solid solution treatment negative | Conditions of hot rolling: heating temperature (°C.) | Conditions of hot rolling: gripping temperature (°C.) | Conditions of hot rolling: reduction (%) | Conditions of hot rolling: finishing temperature (°C.) | Conditions of hot rolling: cooling after rolling (°C.) | Conditions of heat treatment: hardening temperature (°C.) | Conditions of heat treatment: tempering temperature (°C.) | Tensile test: YP (Kgf/mm²) | Tensile test: TS (Kgf/mm²) | Tensile test: El (%) | Impact test: temperature (°C.) | Impact test: vE (Kgf·m) | Test for crack-arresting capability: temperature (°C.) | Test for crack-arresting capability: Kca (Kgf/mm^3/2) | Effective grain size (ASTM No.) |
|---|---|---|---|---|---|---|---|---|---|---|---|---|---|---|---|---|---|---|---|---|
| 32 | Example of the invention | A1 | 1 | x | | 920 | 780 | 40 | 738 | Quenching | — | 575 | 69.8 | 75.0 | 30 | −196 | 25.8 | −196 | 1426 | 11.4 |
| | | | 2 | | x | 960 | 800 | 44 | 743 | " | | | 68.7 | 74.8 | 30 | | 25.6 | | 1420 | 11.3 |
| | | | 3 | x | | 960 | 800 | 44 | 741 | " | | | 68.2 | 74.5 | 30 | | 24.9 | | 1411 | 11.3 |
| | | | 4 | | x | 1000 | 820 | 60 | 751 | " | | | 67.9 | 73.7 | 29 | | 23.8 | | 1360 | 10.8 |
| | Comparative example | | 5 | | x | 1030 | 820 | 50 | 756 | Air-cooling | | | 67.5 | 74.2 | 29 | | 17.6 | | 862 | 8.6 |
| | | | 6 | | x | 1200 | 840 | 42 | 792 | Quenching | | | 66.3 | 76.1 | 30 | | 7.9 | | 582 | 7.2 |
| | | | 7 | | x | 1200 | 840 | 42 | 792 | Air-cooling | 800 | | 69.1 | 73.3 | 30 | | 21.4 | | 676 | 8.0 |
| 30 | Ex. of the invention | A2 | 8 | | x | 1000 | 800 | 52 | 760 | Quenching | — | 575 | 72.5 | 74.6 | 30 | −196 | 22.8 | −196 | 1368 | 10.8 |
| | Comparative ex. | | 9 | | x | 1000 | — | — | 882 | " | | | 71.1 | 74.8 | 29 | | 18.6 | | 826 | 9.1 |
| | Ex. of the invention | B1 | 10 | | x | 960 | 780 | 50 | 730 | " | — | 600 | 73.6 | 77.3 | 29 | −196 | 20.6 | −170 | 1026 | 10.0 |
| | | | 11 | | x | 1000 | 780 | 50 | 741 | " | | | 73.1 | 77.4 | 29 | | 21.8 | | 1105 | 10.1 |
| | Comparative ex. | | 12 | x | | 1050 | 800 | 50 | 756 | " | | | 72.8 | 77.5 | 28 | | 11.6 | | 796 | 8.8 |
| | | | 13 | | x | 1200 | 800 | 50 | 760 | " | | | 71.6 | 76.6 | 28 | | 5.6 | | 668 | 8.2 |
| 25 | Ex. of the invention | C1 | 14 | | x | 920 | 790 | 40 | 746 | " | — | 600 | 48.2 | 56.8 | 32 | −100 | 23.4 | −60 | 1298 | 10.8 |
| | | | 15 | | x | 1000 | 800 | 50 | 741 | " | | | 46.4 | 56.7 | 32 | | 20.6 | | 1256 | 10.5 |
| | Comparative ex. | | 16 | | x | 1000 | 720 | 70 | 640 | " | | | 45.1 | 59.6 | 30 | | 8.1 | | 982 | 8.2 |
| | | | 17 | | x | 1100 | 800 | 50 | 751 | " | | | 47.6 | 56.4 | 30 | | 13.1 | | 806 | 8.1 |
| | | | 18 | | x | 1200 | 800 | 50 | 748 | " | | | 48.1 | 58.2 | 30 | | 7.5 | | 703 | 7.6 |
| | Ex. of the invention | D | 19 | x | | 900 | 770 | 40 | 721 | " | — | 600 | 42.9 | 52.3 | 35 | −100 | 21.3 | −50 | 886 | 11.2 |
| | | | 20 | | x | 1000 | 800 | 50 | 738 | " | | | 41.9 | 51.9 | 35 | | 20.6 | | 815 | 10.9 |
| | Comparative ex. | | 21 | | x | 1000 | 800 | 40 | 742 | Air-cooling | 860 | | 41.3 | 51.9 | 36 | | 19.8 | | 356 | 8.2 |
| | | | 22 | | x | 1150 | 800 | 40 | 768 | Quenching | — | | 40.8 | 50.1 | 34 | | 16.2 | | 342 | 7.8 |
| 30 | Ex. of the invention | E | 23 | | x | 1000 | 820 | 50 | 748 | " | — | 630 | 44.8 | 53.2 | 34 | −100 | 25.1 | −50 | 1016 | 10.3 |
| | Comparative ex. | | 24 | | x | 1000 | 720 | 80 | 640 | " | | | 43.3 | 53.7 | 30 | | 13.6 | | 981 | 10.1 |
| | | | 25 | | x | 1200 | 800 | 44 | 725 | " | | | 43.5 | 54.4 | 33 | | 22.5 | | 750 | 9.2 |
| 40 | Ex. of the invention | F | 26 | x | | 950 | 800 | 50 | 736 | " | — | 575 | 104.6 | 107.2 | 22 | −60 | 18.6 | −80 | 1035 | 11.2 |
| | Comparative ex. | | 27 | x | | 950 | 870 | 55 | 850 | " | | | 101.9 | 107.9 | 22 | | 10.2 | | 826 | 10.3 |

As is clear from Table 2, the steels produced by the method of the present invention comprised finer effective grains and exhibited higher values of crack-arresting capability than the steels produced by comparative methods. Stated more specifically, when either one of the factors of hot rolling (i.e., heating temperature, reduction, gripping temperature and finishing temperature) and subsequent heat treatment (i.e., quenching temperature) was outside the range specified by the present invention, the steels obtained exhibited either very low values of crack-arresting capability or values of crack-arresting capability that were similar level as compared with those of the samples of the present invention except that the value of impact strength became low. It is therefore obvious that steel plates exhibiting high performance in terms of both crack-arresting capability and cryogenic toughness cannot be obtained consistently unless the process of the present invention is employed.

As described in the foregoing pages, the process of the present invention enables the production of steels having a high crack-arresting capability that has not been previously obtained with conventional refined steels. The present invention will therefore make a great contribution to industry in enhancing the safety level of cryogenic tanks for storing liquefied gases.

What is claimed is:

1. A process for producing a Ni-steel with high crack-arresting capability, which is used for building cryogenic containers for the storage of LPG and LNG, comprising the steps of:

heating to a temperature between 900° and 1000° C. a steel material consisting essentially of 5.14–10.0% Ni, 0.01–0.20% C, not more than 0.5% of Si, 0.1–2.0 Mn, 0.005–0.1% sol. Al, and the balance being Fe and incidental impurities;

hot-rolling the steel material to provide a cumulative reduction of 40–70% at 850° C. or below, and finishing the rolling operation at 700°–800° C.;

immediately after completion of the rolling step, quenching the steel material to a temperature not higher than 300° C.; and subsequently tempering the quenched steel material at a temperature not higher than the $Ac_1$ point.

2. The process as described in claim 1 wherein said steel material further contains one or more elements selected from the group consisting of 0.05–1.0% Mo, 0.1–1.5% Cr, 0.1–2.0% Cu, and not more than 1.0% of Nb, V or Ti.

3. The process as described in claim 1 wherein the Ni content of the steel material ranges from 5.14 to less than 8%.

4. The process as described in claim 1 wherein the steel material is quenched at a cooling rate of more than 10° C./sec.

5. The process as described in claim 2 wherein the steel material is quenched at a cooling rate of more than 10° C./sec.

6. The process as described in claim 3 wherein the steel material is quenched at a cooling rate of more than 10° C./sec.

* * * * *

UNITED STATES PATENT AND TRADEMARK OFFICE

CERTIFICATE OF CORRECTION

PATENT NO. : 4,776,900

DATED : October 11, 1988

INVENTOR(S) : Seinosuke YANO, Naoki SAITO

It is certified that error appears in the above-identified patent and that said Letters Patent is hereby corrected as shown below:

Claim 1, line 8, change "0.1-2.0 Mn" to --0.1-2.0% Mn--.

Signed and Sealed this

Twenty-eighth Day of November 1989

*Attest:*

JEFFREY M. SAMUELS

*Attesting Officer* *Acting Commissioner of Patents and Trademarks*